US011125196B2

(12) United States Patent
Billot et al.

(10) Patent No.: US 11,125,196 B2
(45) Date of Patent: Sep. 21, 2021

(54) BOTTOM MOUNT FUEL PUMP ASSEMBLY

(71) Applicant: Walbro LLC, Tucson, AZ (US)

(72) Inventors: Darin R. Billot, Snover, MI (US); George M. Pattullo, Caro, MI (US)

(73) Assignee: Walbro LLC, Cass City, MI (US)

( * ) Notice: Subject to any disclaimer, the term of this patent is extended or adjusted under 35 U.S.C. 154(b) by 0 days.

(21) Appl. No.: 16/871,550

(22) Filed: May 11, 2020

(65) Prior Publication Data

US 2020/0355148 A1 Nov. 12, 2020

Related U.S. Application Data

(60) Provisional application No. 62/846,004, filed on May 10, 2019.

(51) Int. Cl.

| | |
|---|---|
| ***F02M 37/10*** | (2006.01) |
| ***F02M 37/00*** | (2006.01) |
| ***F02M 37/50*** | (2019.01) |
| ***F02M 37/08*** | (2006.01) |

(52) U.S. Cl.

CPC ..... *F02M 37/103* (2013.01); *F02M 37/0017* (2013.01); *F02M 37/0029* (2013.01); *F02M 37/0076* (2013.01); *F02M 37/50* (2019.01); *F02M 2037/087* (2013.01)

(58) Field of Classification Search

CPC ..... F02M 37/103; F02M 37/0017; F02M 37/0076; F02M 37/0029; F02M 37/50; F02M 2037/087; F02M 37/106

See application file for complete search history.

(56) References Cited

U.S. PATENT DOCUMENTS

| | | | | |
|---|---|---|---|---|
| 5,647,328 | A | 7/1997 | Fournier et al. | |
| 6,203,286 | B1 * | 3/2001 | Moll | F02M 37/10 123/509 |
| 6,213,100 | B1 | 4/2001 | Johansen | |
| 6,231,318 | B1 | 5/2001 | Cotton et al. | |
| 6,761,193 | B1 | 7/2004 | Cotton et al. | |
| 6,966,305 | B2 | 11/2005 | Aubrée et al. | |
| 7,475,678 | B2 | 1/2009 | Douyama et al. | |
| 10,259,313 | B2 | 4/2019 | Hanby et al. | |
| 10,549,631 | B2 | 2/2020 | Hanby et al. | |

(Continued)

FOREIGN PATENT DOCUMENTS

EP 1043495 A2 * 10/2000 ..... F02M 37/106

*Primary Examiner* — Jacob M Amick
*Assistant Examiner* — Charles J Brauch
(74) *Attorney, Agent, or Firm* — Reising Ethington P.C.

(57) ABSTRACT

An assembly includes a mounting flange, support, carrier, reservoir and fuel pump. The mounting flange has a fluid passage extending through the mounting flange. The support is coupled to the mounting flange, and the carrier is coupled to the support with the weight of the carrier acting in compression on the support. The reservoir is carried by at least one of the carrier and the mounting flange with the weight of the reservoir acting on the carrier and/or the mounting flange, and the reservoir defining an interior. The fuel pump is carried by at least one of the carrier and the reservoir, the fuel pump has an inlet received within the reservoir interior and an outlet from which pressurized fuel is discharged from the fuel pump when the fuel pump is operating. The support defines at least part of a passage that is communicated with a fluid source.

20 Claims, 7 Drawing Sheets

(56) References Cited

U.S. PATENT DOCUMENTS

| | | | | |
|---|---|---|---|---|
| 2006/0000452 | A1* | 1/2006 | Tokuda | F02M 63/0225 123/456 |
| 2014/0239097 | A1* | 8/2014 | Cotton | F02M 37/103 239/533.2 |

* cited by examiner

BOTTOM MOUNT FUEL PUMP ASSEMBLY

REFERENCE TO RELATED APPLICATIONS

This application claims the benefit of U.S. Provisional Application Ser. No. 62/846,004 filed on May 10, 2019, the entire contents of which is incorporated herein by reference in its entirety

TECHNICAL FIELD

The present disclosure relates generally to a fuel pump assembly.

BACKGROUND

Vehicles typically include a fuel system with a fuel tank, a fuel pump that pumps fuel from the tank to a vehicle engine to support operation of the engine, and sometimes other components, such as a fuel level sensor, fuel pressure regulator, fuel injectors, fuel filter and the like. In some vehicles, the fuel pump is mounted within the vehicle fuel tank as part of a module or assembly that may include other components of the fuel system, such as the fuel level sensor and one or more fuel filters. Some modules have been mounted in the fuel tank by a mounting flange received in an opening of a fuel tank and secured to and suspended from a top wall of the fuel tank. Often, the fuel tanks are disposed in relatively small and oddly shaped areas which can lead to a wide range of shapes and sizes of fuel tanks. Some fuel tanks may have a limited depth or other constructions that make it difficult to insert a module that includes full size accessories or components into the fuel tank. Further, there is a need for improved routing of fuel within a fuel pump assembly and in and out of a fuel tank, with easy to assemble and a reduced number of components.

SUMMARY

In at least some implementations, a fuel pump assembly includes a mounting flange, support, carrier, reservoir and fuel pump. The mounting flange has a first surface with a sealing area, a second surface opposite to the first surface, and a fluid passage extending through the mounting flange. The support is coupled to the mounting flange, and the carrier is coupled to the support with the weight of the carrier providing a compression force on the support. The reservoir is carried by at least one of the carrier and the mounting flange with the weight of the reservoir acting on the carrier and/or the mounting flange, and the reservoir defining an interior. And the fuel pump is carried by at least one of the carrier and the reservoir. The fuel pump has an inlet received within the reservoir interior and an outlet from which pressurized fuel is discharged from the fuel pump when the fuel pump is operating, wherein the support defines at least part of a passage that is communicated with a fluid source.

In at least some implementations, the reservoir is supported at least partially by the carrier and is suspended above the mounting flange.

In at least some implementations, the passage defined by the support is communicated with the fuel pump and wherein, when the fuel pump discharges pressurized fuel, at least some of the pressurized fuel flows through the support. In at least some implementations, the passage defined by the support is communicated with an outlet of a vent valve.

In at least some implementations, the support is a first support and the fluid passage is a first fluid passage, and the assembly includes a second support that is coupled to the mounting flange and to the carrier, and the mounting flange includes a second fluid passage separate from the first fluid passage, and the second support defines a passage that is communicated with the second fluid passage.

In at least some implementations, the carrier includes a passage communicated with the fuel pump and with a secondary fuel pump to provide fuel from the fuel pump to the secondary fuel pump. The secondary fuel pump may include a nozzle, a venturi and an inlet and fuel flow through the nozzle and venturi draws fuel through the inlet of the secondary fuel pump. The inlet of the secondary fuel pump may be communicated with a fuel passage having an end spaced from the inlet of the secondary fuel pump so that fuel remote from the secondary fuel pump inlet may be drawn into the secondary fuel pump inlet.

In at least some implementations, the carrier includes a passage communicated with the fuel pump and with a pressure regulator to provide fuel from the fuel pump to the pressure regulator.

In at least some implementations, the mounting flange includes a first coupling feature to which the support is coupled, and the carrier includes a second coupling feature to which the support is coupled, and wherein the first coupling feature and second coupling feature both include openings communicated with the passage defined by the support.

In at least some implementations, a fuel control valve is carried by the carrier and a secondary fuel pump carried by the carrier.

In at least some implementations, the reservoir has a lower wall and a sidewall extending vertically from the lower wall to retain fuel in the reservoir, and the carrier is coupled to or arranged adjacent to an upper end of the sidewall. The lower wall of the reservoir may be supported on the mounting flange. The lower wall of the reservoir may be spaced from the mounting flange. The lower wall may be defined by the mounting flange.

In at least some implementations, an assembly for a fuel system, includes a fuel tank, a mounting flange, a support, a carrier, a reservoir and a fuel pump. The fuel tank has a lower wall that defines part of an interior in which fuel is received, and fuel is received on the lower wall under the force of gravity. The mounting flange is secured to the lower wall, and has a first surface with a sealing area and a fluid passage extending through the mounting flange. The support is coupled to the mounting flange. The carrier is coupled to the support and suspended above the flange at least in part by the support. The reservoir is carried by at least one of the carrier and the mounting flange, and the reservoir defining an interior. And the fuel pump is carried by at least one of the carrier and the reservoir, has an inlet received within the reservoir interior and an outlet from which pressurized fuel is discharged from the fuel pump when the fuel pump is operating. The support defines a passage that is communicated with a fluid source and permitting fluid flow through the support.

In at least some implementations, the carrier includes a carrier passage communicating with a component including the fuel pump, a secondary fuel pump or a vent valve, and in operation of the assembly fluid flows through the carrier passage to an inlet of the component or fluid flows through the carrier passage from an outlet of the component.

In at least some implementations, the carrier passage is communicated with the passage defined by the support. The fluid passage in the mounting flange, the carrier passage and the passage defined by the support may all define part of the same fluid flow path.

In at least some implementations, the mounting flange and/or carrier may be used with different size reservoirs. Other components, like one or more of a filter, pressure regulator, fuel pump, secondary pump, vent and the like may be the same as well, to enable efficient provision of a range of fuel pump assemblies having different reservoir capacities or other characteristics. The assembly may be mounted to a bottom or lower wall of a fuel tank and extend upwardly into an interior of the fuel tank. The mounting flange, supports and carrier may have openings or passages therethrough for fluid flow into and out of the fuel tank, and between and among the various components of the fuel pump assembly. Of course, other arrangements and assemblies will be known from the teachings and disclosure provided herein, with respect to various disclosed implementations which include and are representative of various innovations.

BRIEF DESCRIPTION OF THE DRAWINGS

The following detailed description of certain embodiments and best mode will be set forth with reference to the accompanying drawings, in which.

DETAILED DESCRIPTION

Figure 1:
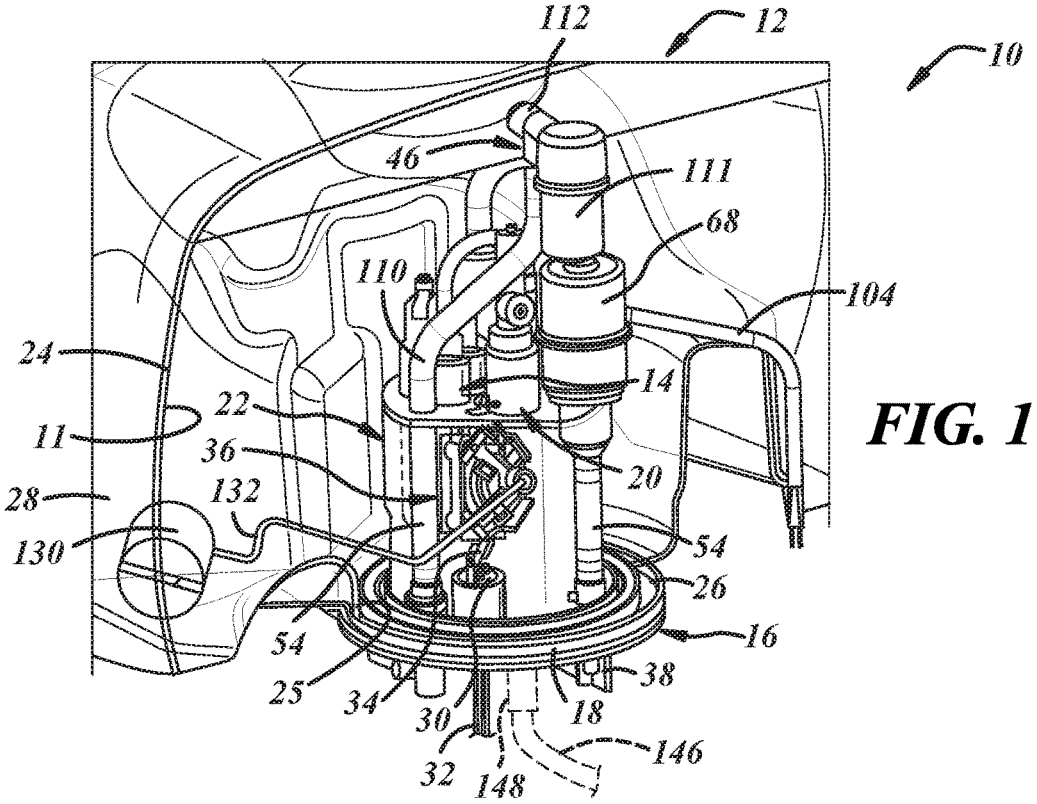
FIG. 1 is a perspective view of a fuel pump assembly mounted to a lower wall of a fuel tank.
Figure 2:
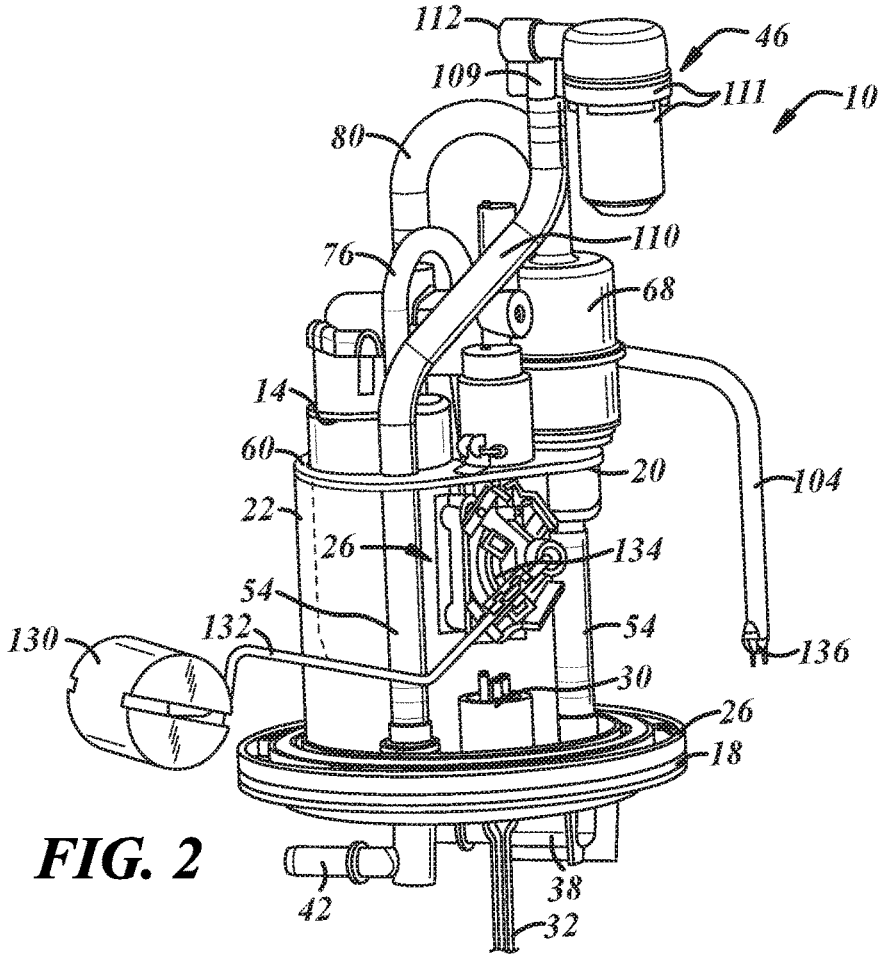
FIG. 2 is a perspective view of the fuel pump assembly.

Referring in more detail to the drawings, FIG. 1 illustrates a fuel pump assembly 10 that is constructed and arranged to be disposed at least partially within the interior 11 of a fuel tank 12 (only part of which is shown), such as in a marine vehicle, snowmobile, ATV, motorcycle, automobile, tractors, and riding mowers, which are non-limiting examples. The assembly 10 may include an electric motor driven fuel pump 14 that delivers fuel under pressure from the fuel tank 12 to an engine to support operation of the engine.

The fuel pump assembly 10 includes a body assembly 16 that may have a mounting flange 18, a carrier 20 and a reservoir 22. The mounting flange 18 is arranged to be fixed and sealed to a wall 24 of the fuel tank, which may be a lower or bottom wall on which fuel is received under the force of gravity (that is, the lower or bottom wall is relative to the direction of gravity). The wall 24 may be continuous with the lower or bottom defined by a part of the wall 24 that is lowest relative to gravity in the installed position of the tank 12. The wall 24 may define at least part of the interior 11 in which fuel is maintained. The tank wall 24 may include an opening 25 through which part of the fuel pump assembly 10 is inserted with, in at least some implementations, at least part of the flange 18 outboard of the tank interior 11 and overlying part of the tank wall 24. The mounting flange 18 may be molded of a polymeric material suitable for use with a polymeric fuel tank 12, and to be sealed to the fuel tank wall 24, or the flange 18 may be formed from metal or any other suitable material. The mounting flange 18 may have a radially outwardly extending lip 26 adapted to overlie and be sealed to the lower fuel tank wall 24 surrounding the opening 25, such as at or to an outer surface 28 of the wall.

As shown in FIGS. 1-4, the mounting flange 18 may carry one or more components or accessories of the fuel pump module 10, such as an electrical connector or electrical pass through region 30 (e.g. an area through which wires 32 may pass through the flange 18, preferably with a seal between the wires 32 and flange 18). The electrical connector or pass through region 30 may couple together wires 32 external to the fuel tank 12 with wires 34 within the fuel tank 12 and connected to, for example, the fuel pump 14 and a fuel level sender 36. In this way, power may be provided to the components 14, 36 within the tank 12, and signals (e.g. indicative of fuel level) from the components may be provided to a location outside of the tank. The fuel level sender 36 and electrical connector or pass through region 30 may be of generally standard construction and will not be described further herein.

To permit fluid flow through the flange 18, the flange may include one or more fluid fittings that define passages through the flange and facilitate connecting conduits thereto so that fuel may be routed in the fuel system as desired. As shown in FIGS. 2-6, a first fluid fitting 38 with an internal passage 40 (FIG. 4) may be provided on or molded with the mounting flange 18 and may communicate the outlet of the fuel pump 14 with a fuel line through which fuel is delivered to the engine. A second fluid fitting 42 with an internal passage 44 may be provided on or molded with the mounting flange 18 and may communicate with a vent valve 46 received within the fuel tank interior 11 to permit fuel vapors to be vented from the interior 11 of the tank 12 through the second fitting 42.

Figure 6:
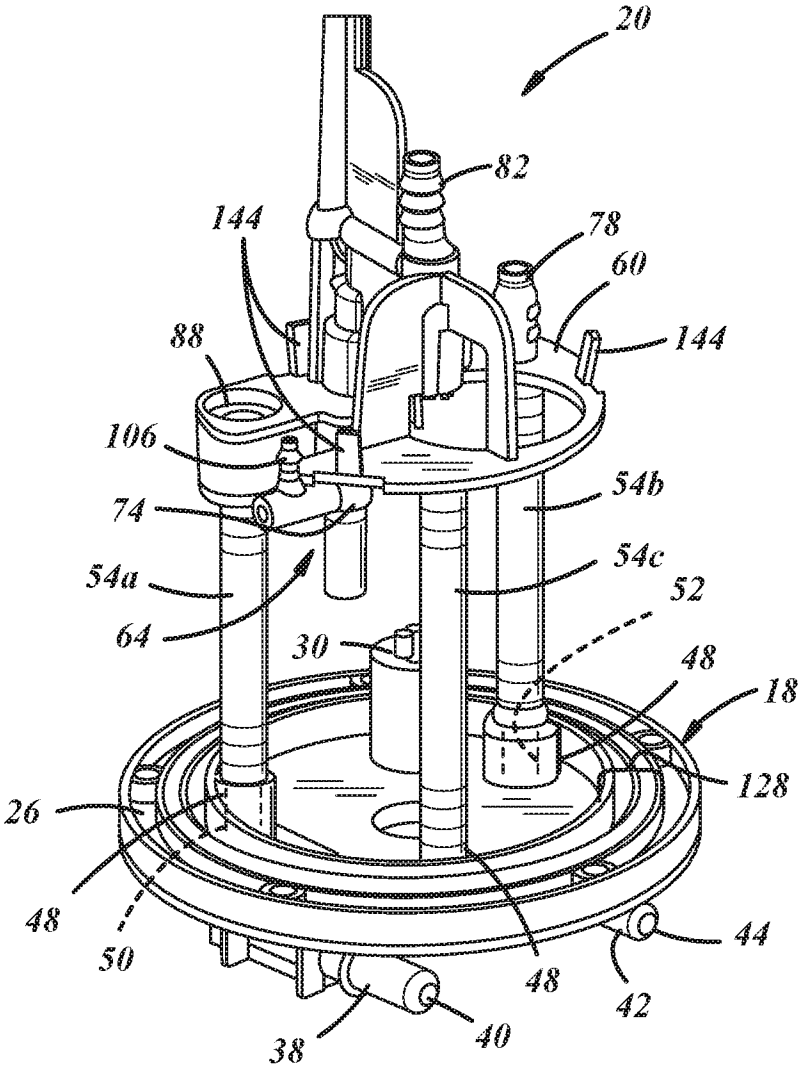
FIG. 6 is a rear perspective view of the mounting flange and carrier.

As shown in at least FIG. 6, the mounting flange 18 may include one or more first coupling features 48 that may extend into or are otherwise open to the interior 11 of the fuel tank 12 and which may be constructed and arranged to facilitate coupling one or more of the reservoir 22, carrier 20 and the fuel pump 14 to the flange 18. The first coupling features 48 may include one or more blind bores in cylindrical projections extending from the flange 18, or one or more projections extending from the flange 18 into the fuel tank 12 (e.g. toward the fuel tank interior 11), or both. In at least some implementations, a first coupling feature 48 may be aligned with or define at least part of a passage or opening 50 (shown in phantom lines in FIG. 6) that is communicated with the passage 40 in the first fluid fitting 38 to permit fluid (e.g. liquid or gaseous matter) to flow into and through the first fluid fitting 38. In at least some implementations, a different one of the first coupling features 48 likewise includes or is aligned with a different passage or opening 52 (shown in phantom lines in FIG. 6) in the flange 18 that is communicated with the passage 44 in the second fluid fitting 42 to permit fluid (e.g. liquid or gaseous matter) to flow through the opening 52 and into the second fluid fitting 42.

Figure 8:
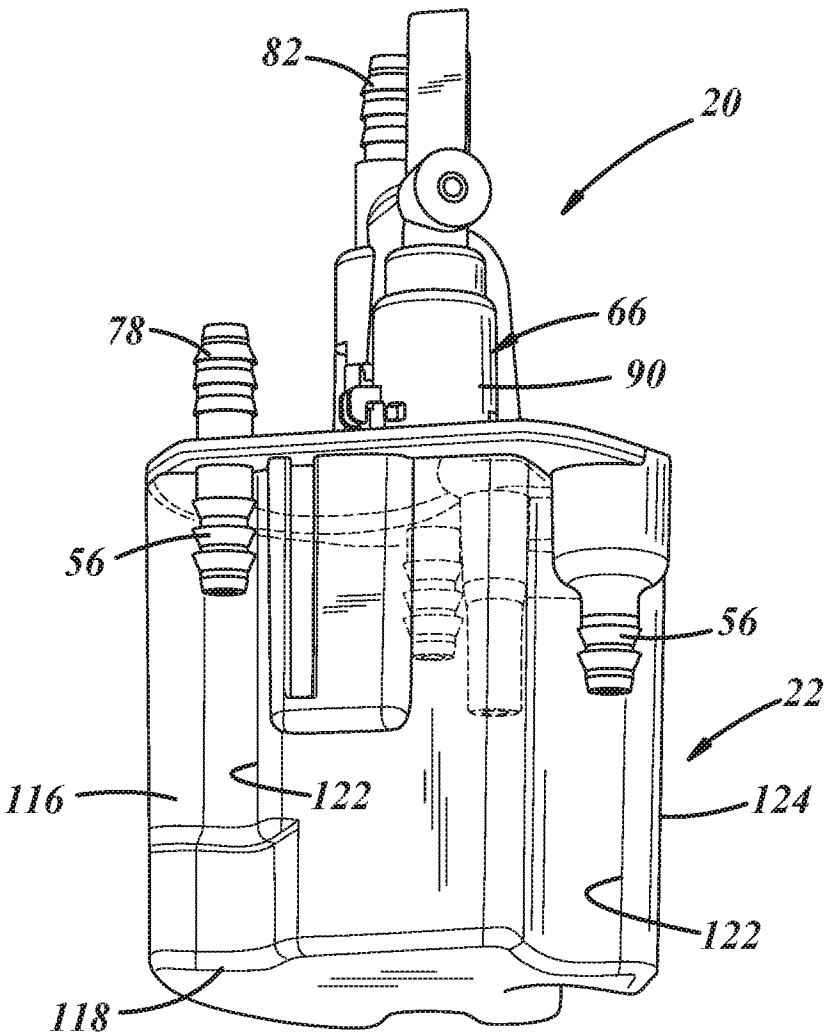
FIG. 8 is a front perspective view of the carrier and reservoir.
Figure 7:
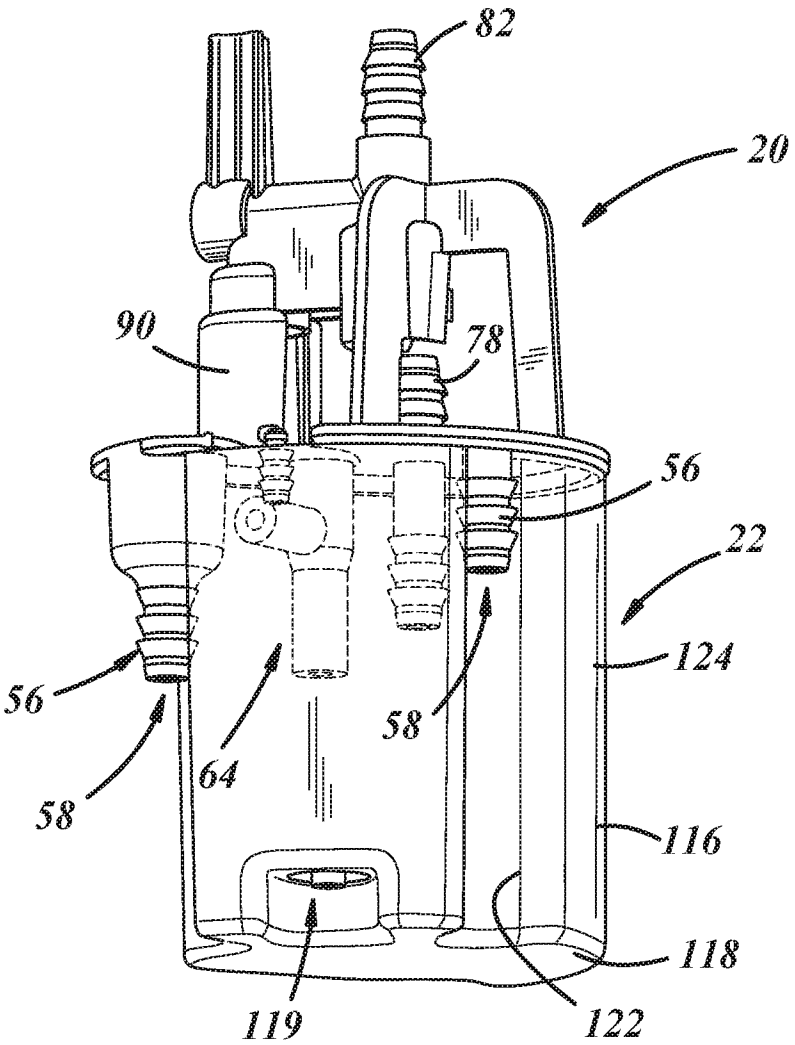
FIG. 7 is a perspective view of the carrier and reservoir.
Figure 9:
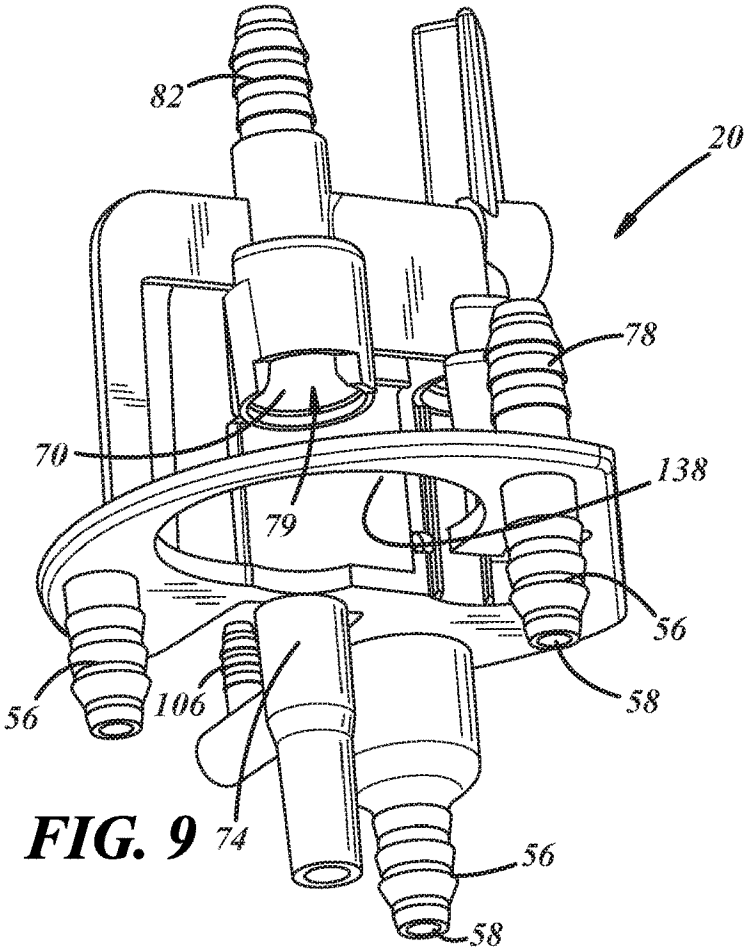
FIG. 9 is a perspective view of the carrier.

The carrier 20 may be coupled to the flange 18 by one or more supports 54. As shown in FIGS. 7-9, the carrier 20 may include one or more second coupling features 56, and each support 54 may be coupled at one end to a respective one of the first coupling features 46 of the mounting flange 18 and at their other end to a respective second coupling feature 56 of the carrier 20. The carrier may be suspended above the flange (relative to gravity) and the carrier and components thereon may provide a compression force on the supports.

In at least some implementations, the supports 54 may be coupled to the flange 18 and carrier 20 without any additional fasteners, to facilitate assembly and reduce complexity and cost of the fuel pump assembly 10. For example, where the coupling features 48, 56 include protrusions, the supports 54 may include cavities or passages sized to be press-fit over or onto the protrusions. And where the coupling features 48, 56 includes a cavity (e.g. a blind bore), the supports 54 may be pressed or otherwise received in the cavity. In some implementations, the first or second coupling features 48, 56 may be defined by a cylindrical and tubular wall having an axis, and the associated support 54 may be pressed into the cavity defined within the wall, or over the exterior surface of the wall, such that the wall is received within the support. The support(s) 54 may be separate from the flange 18 and/or carrier 20, or at least one support 54 may be formed integrally with either the carrier 20 or the flange 18, if desired. The connection between the mated components 48, 54, 56 may be maintained with an interference or friction fit to inhibit unintended separation of the components, if desired. Adhesives, threads, welds, clamps, snap/locking features or other modes of connection may be used to maintain the connection between the components, but are not needed in all implementations.

At least one of the second coupling features 56 may be aligned with or define at least part of an opening or passage 58 (shown, for example, in FIG. 9) in the carrier 20 to permit fluid (e.g. liquid or gaseous matter) to flow through the carrier 20. In the example shown, one or more of the supports 54 are tubular bodies that have internal passages so that a support 54 that is aligned with an opening 58 in the carrier 20 and an opening (e.g. opening 50 or 52) in flange 18 routes fluid from the carrier 20 opening to one of the flange fittings 38 or 42. Thus, in at least some implementations, at least one support 54 may define part of a fluid flow path in the fuel pump assembly 10 and also part of the structural support for the carrier 20 or other portion of the fuel pump assembly 10. In at least some implementations, each fluid fitting 38, 42 of the flange 18 is communicated with the internal passage of a respective support (labeled in FIGS. 6 as 54*a* and 54*b*) and may also be communicated with an opening 58 in the carrier 20. In the illustrated example, there are two fluid fittings 38, 42 and each fluid fitting 38, 42 is communicated with a first coupling feature 48 having an opening 50, 52, and a corresponding opening 58 in the carrier 20 via the supports 54*a*, 54*b*. Also in the illustrated example, a third support (labeled 54*c* in FIG. 6) is not communicated with any opening 58 in the carrier 20 or any fitting 38, 42 of the mounting flange 18, and fluid does not flow through this third support 54*c*. Of course, any desired number of supports 54 may be provided between the carrier 20 and flange 18, and any number of these supports 54 may permit fluid flow therethrough, including none of the supports 54.

The carrier 20 may include a base 60 that generally overlies at least part of an upper end 62 or rim of the reservoir 22, and from which other components or features of the carrier 20 may extend. The other features include sockets, recesses, fittings or projections that receive or mount components like a secondary fuel pump 64 (FIG. 11), a fuel pressure regulator 66 (FIG. 12), or a fuel filter 68. For example, a first socket or fitting 70 of the carrier 20 is arranged to be received over an outlet tube or fitting 72 (FIG. 12) of the fuel pump 14, to receive fuel discharged under pressure from the fuel pump 14. This carrier fitting 70 is in the fuel flow path from the fuel pump 14 to the first fitting 38 in the flange 18. A second carrier fitting 74 receives a secondary fuel outlet tube 76 that communicates with a second outlet 77 (FIG. 11) of the fuel pump 14 to receive fuel discharged under pressure from the fuel pump 14 which is used to drive the secondary fuel pump 64 as set forth below. A third carrier fitting 78 is aligned with a second coupling feature 56 and an opening 58 through which fluid flows and defines part of the fluid flow path from, for example, the vent valve 46 to the second fitting 42 in the flange 18. In at least some implementations, these carrier fittings and features may be formed in the same piece of material so that the carrier 20 is defined by a single piece of material which may, for example, be molded from a polymeric material. Other fittings and features may be provided integrally in or otherwise carried by the carrier 20 to mount components and/or route fuel in and among the various components of the assembly 10.

Figure 3:
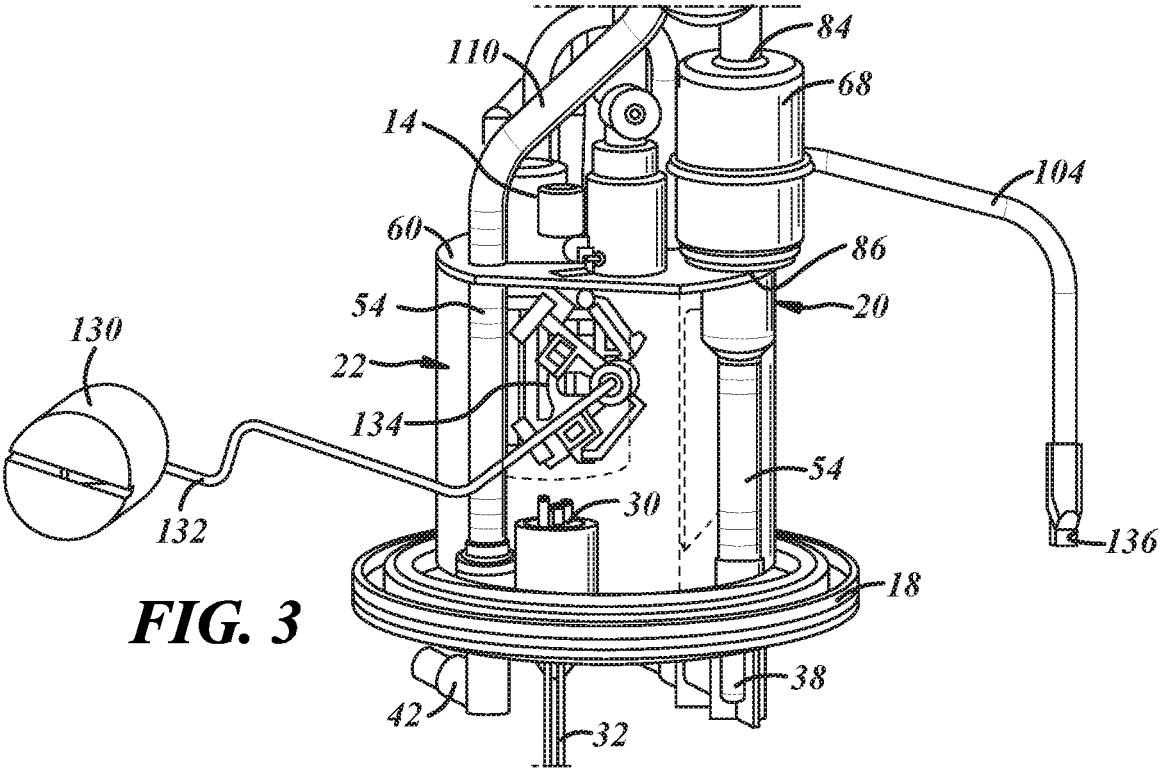
FIG. 3 is a front perspective view of the fuel pump assembly.
Figure 4:
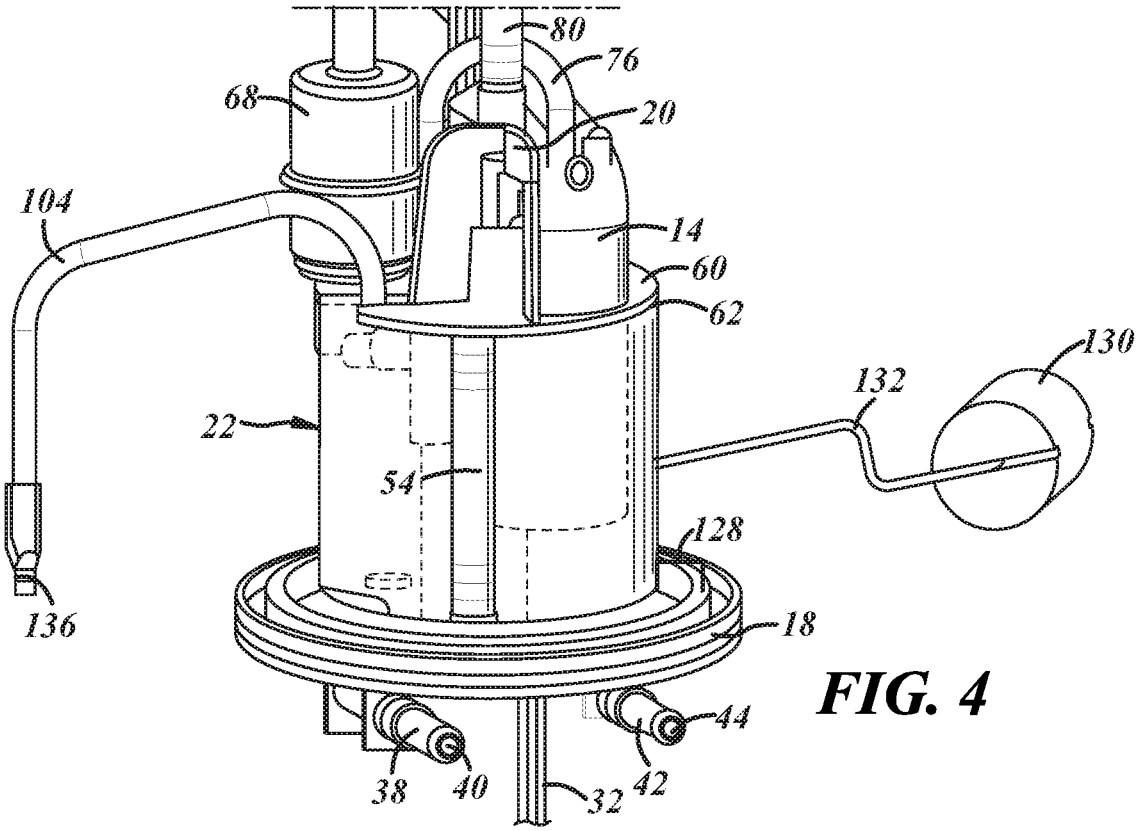
FIG. 4 is a rear perspective view of the fuel pump assembly.
Figure 5:
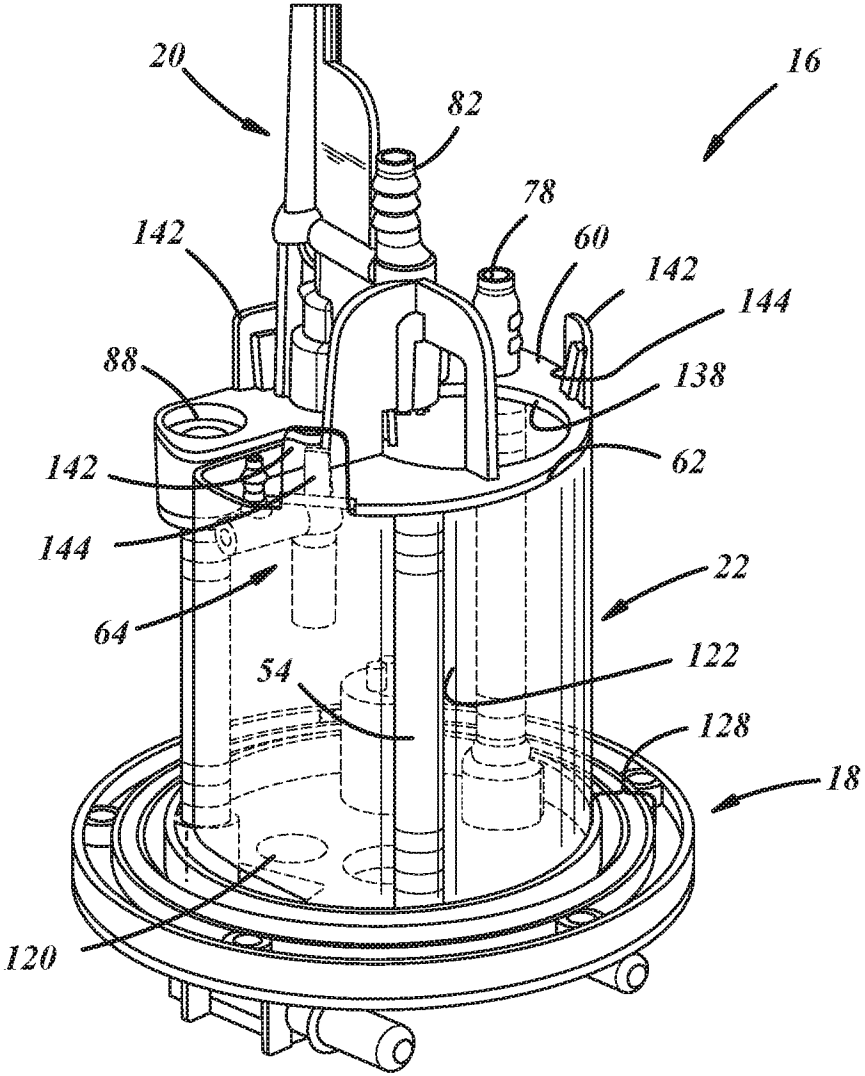
FIG. 5 is a rear perspective view of a body assembly including a mounting flange, carrier and reservoir.
Figure 10:
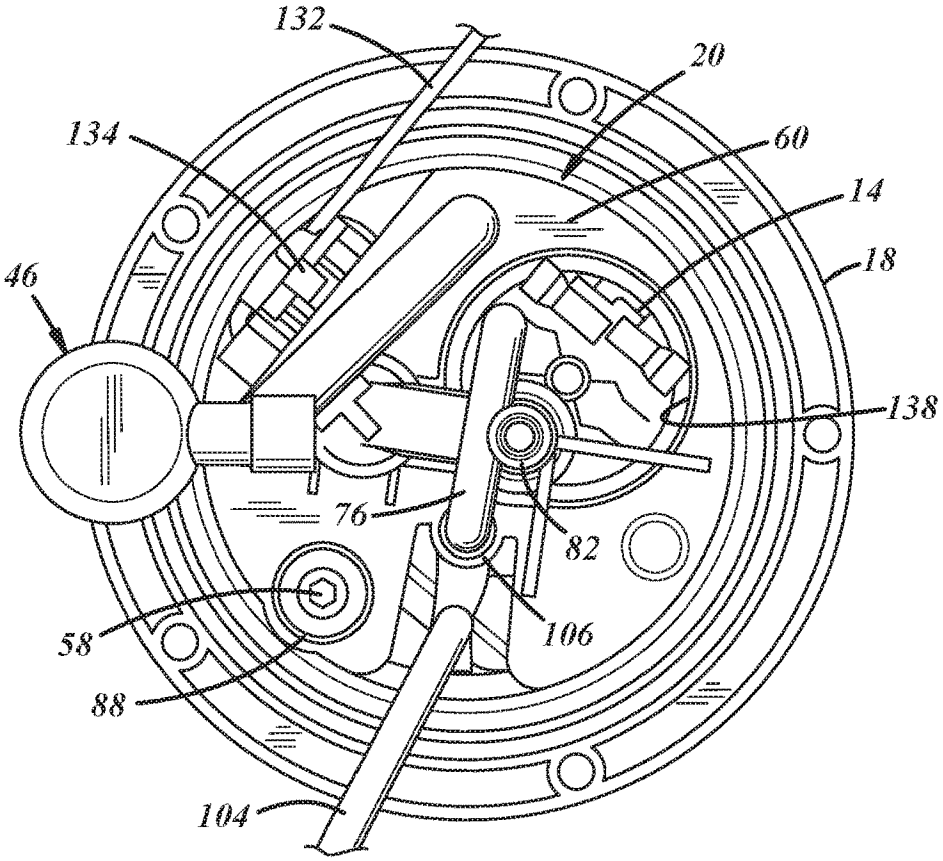
FIG. 10 is a plan view of the fuel pump assembly.

The first carrier fitting 70, which receives the outlet 72 of the fuel pump 14, defines part of a passage 79 (FIGS. 9 and 12) that leads to a tube 80 fitted over a corresponding outlet fitting or fourth carrier fitting 82. As shown in FIG. 3, in the example shown, the tube 80 is also coupled to an inlet 84 of the fuel filter 68 which has an outlet 86 coupled to the carrier 20 or otherwise communicated with an opening 58 in the carrier 20 (e.g. via a connection feature 88, fitting or otherwise). The connection feature/fitting 88 of the carrier 20 is shown in FIGS. 5, 6 and 10 as being a recess in the carrier 20 which may define part of or lead to an opening 58 and associated second coupling feature 56 of the carrier 20 which in turn leads to a support 54 through which fluid flows to the first fitting 38 of the flange 18 for delivery of pressurized fuel to the engine.

Figure 12:
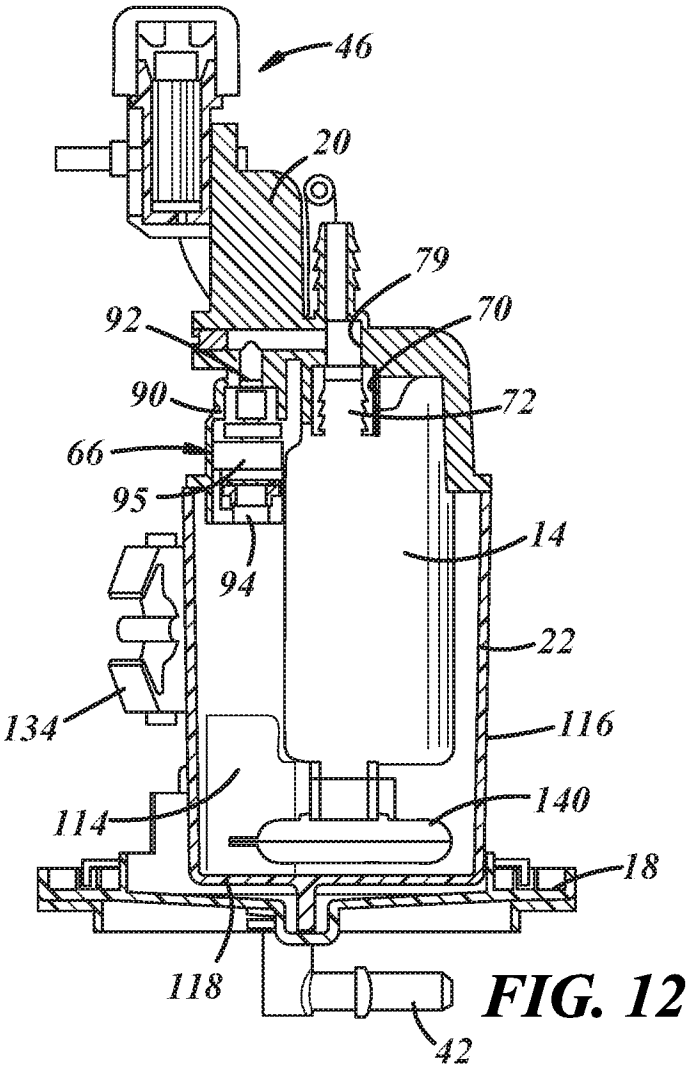
FIG. 12 is a sectional view of the fuel pump assembly showing a fuel pressure regulator and certain features within the reservoir.

The passage 79 in the carrier 20 may also communicate with the fuel pressure regulator 66 or other fluid flow control valve. As shown in FIG. 12, the fuel pressure regulator 66 may be carried by the carrier 20, such as by being received at least partially within a recess or other connection feature 90 formed in the carrier 20. The fuel pressure regulator 66 may include an inlet 92 that receives fuel discharged from the fuel pump 14 and received in or through the first carrier fitting 70, an outlet 94 from which fuel is discharged into the reservoir interior or into the fuel tank 12, and a valve 95 that controls fuel flow through the outlet 94. In at least some implementations, the valve 95 is closed and prevents or substantially restricts fuel flow through the outlet 94 when the pressure of fuel at the inlet 92 is below a threshold, and the valve opens and permits fuel flow through the outlet 94 when the pressure of fuel at the inlet 92 is above the threshold. In this way, the fuel pressure delivered from the fuel pump assembly 10 via the first fitting 38 in the flange 18 is limited to a predetermined maximum pressure.

Figure 11:
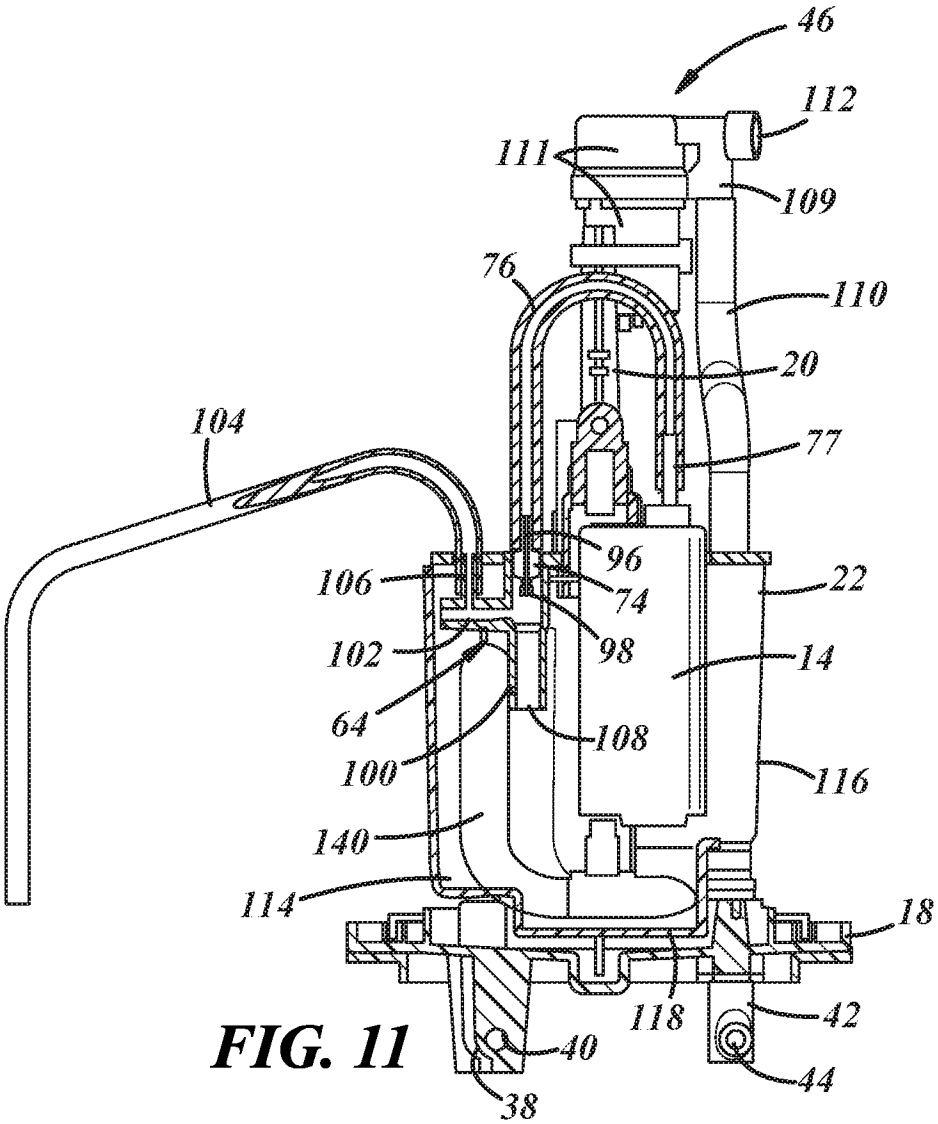
FIG. 11 is a sectional view of the fuel pump assembly showing a secondary fuel pump and certain features within the reservoir.

As shown in FIG. 11, the second fitting 74 of the carrier 20 leads to a second passage 96 defined in the carrier 20 which is communicated with the secondary fuel pump 64. The secondary fuel pump 64, which may be a so-called jet pump, may be received in or communicated with the second passage 96, and may include a jet or nozzle 98 through which fuel is discharged at increased velocity. The nozzle 98 may discharge into a larger volume portion of the second passage 96 or a tube 100 that is carried by the carrier 20. The second passage 96 (or the passage in tube 100) may have a narrowing inlet and a diverging outlet (e.g. defining a venturi passage), if desired. The flow of fuel from the nozzle 98 and through the passage 100 creates a drop in pressure in an area of the jet pump 64 that is communicated with a pump inlet 102, to draw fuel into the pump inlet 102. In the example shown, the pump inlet 102 is communicated (e.g. via a tube 104 fitted onto a fitting 106 of the carrier 20 that is open to the second passage 96) with a portion of the fuel tank interior 11 spaced from the reservoir 22, and which may communicate with a lower or lowest portion of the fuel tank interior 11 to draw fuel from that area of the fuel tank into the jet pump 64. Fuel drawn into the jet pump 64 is combined with fuel flowing through the tube 100 and that fuel flows out of an outlet 108 of the tube 100 which is communicated with the interior of the fuel reservoir 22. Thus, the jet pump 64 draws fuel from the fuel tank 12 and discharges that fuel, along with a portion of the fuel discharged from the fuel pump 14, into the reservoir interior where that fuel is available to the inlet of the fuel pump 14.

The third carrier fitting 78 may be coupled to another fuel system component, and is shown as being communicated with an outlet 109 of the vent valve 46 via a connecting tube 110. The vent valve 46 may have a body 111 with an inlet 112 located generally adjacent to an upper wall or upper portion of fuel tank wall 24 so that the inlet 112 is communicated with gaseous fluid above the level of fuel in the fuel tank interior 11. The vent valve body 111 may be coupled to the fuel tank wall 24, or it may be held in an upper portion of the fuel tank interior 11 (where upper relates to the direction of gravity) by the tube 110, or by a support or bracket of the carrier 20, as desired. The support or bracket of the carrier 20 may be integrally formed in the same piece of material as other portions of the carrier 20, or may be separate and attached of the carrier 20, as desired. The vent valve 46 may be of conventional construction, and may have a valve (not shown) that closes when acted upon by liquid fuel to prevent fuel from flowing through the outlet 109 and tube 110, even in the event of an inversion of the fuel tank 12. When the valve is open, gaseous matter (e.g. fuel vapor and air) may flow into the vent valve inlet 112, through the valve, out of the vent valve outlet 109, through the tube 110, carrier opening 58, support 54 and through the second fitting 42 in the flange. In this way, the fuel tank interior may be vented while liquid fuel is inhibited or prevented from flowing out of the tank through this flow path.

Figure 14:
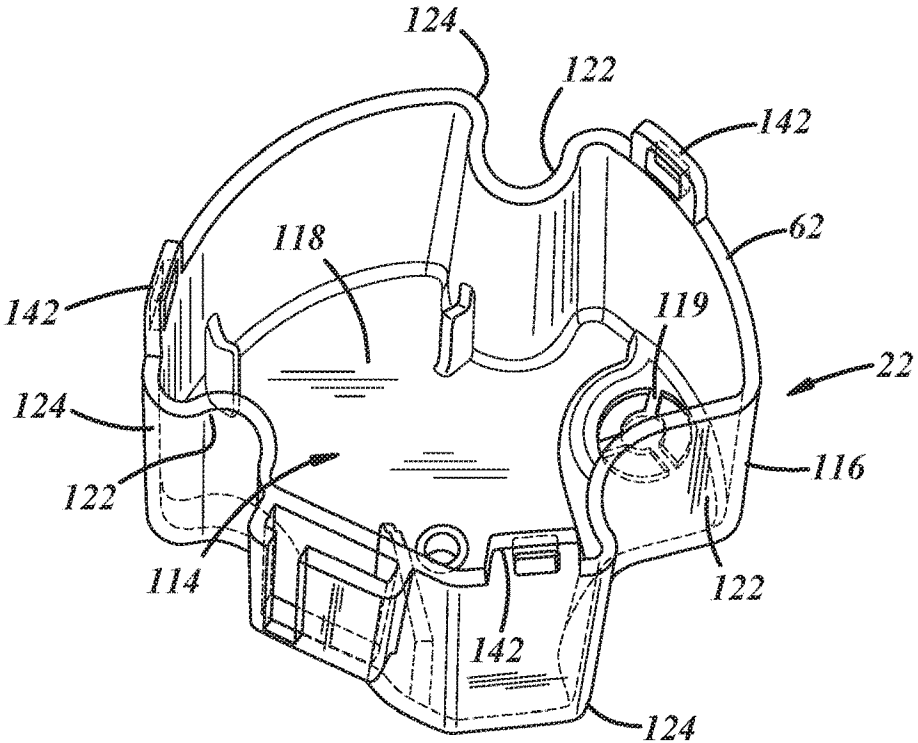
FIG. 14 is a perspective view showing the interior of the reservoir.
Figure 13:
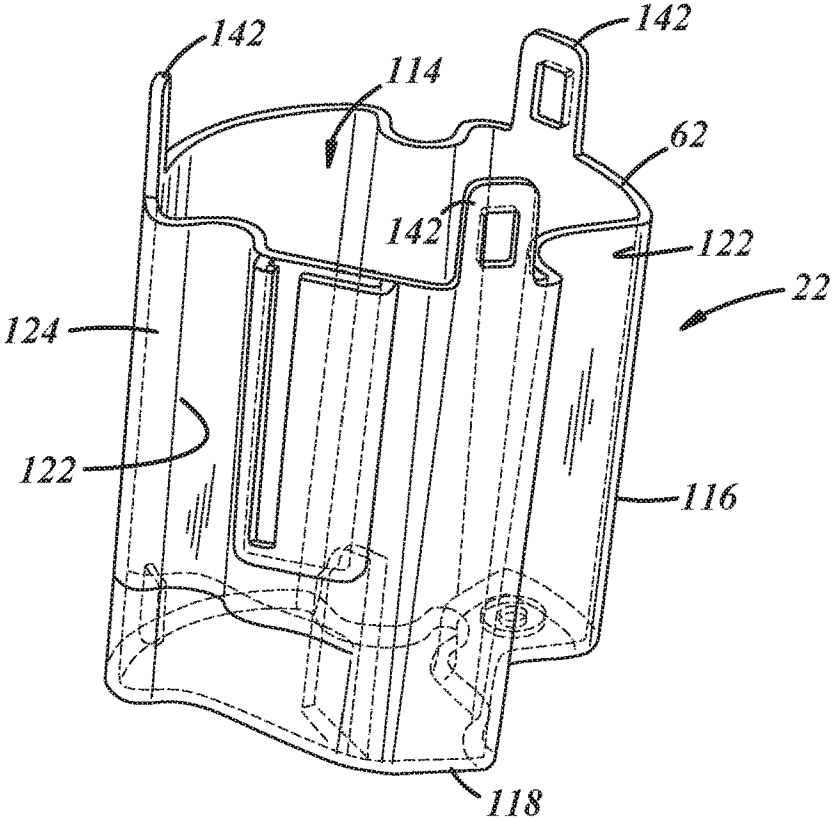
FIG. 13 is a perspective view of the exterior of the reservoir.

As noted above, the reservoir 22 defines at least part of an interior space 114 in which a supply of liquid fuel is retained. The reservoir 22 may be generally cup-shaped with a sidewall 116 extending vertically from a generally horizontally arranged lower wall 118 which may be integrally formed in the same piece of material, if desired. The other or upper end 62 of the reservoir 22, opposite to the lower wall 118, may be open, and the carrier 20 may be coupled to or arranged adjacent to the upper end 62 of the reservoir 22. In at least some implementations, the reservoir 22 may be open at both ends, that is, may comprise only the sidewall 116, the sidewall 116 may be coupled to the flange 18, and the interior 114 may be defined partially by the flange 18. The reservoir 22 may include a seat 119 (FIG. 14) for a check valve 120 (FIG. 5) located in or adjacent to the lower wall 118 and arranged to permit fuel from the fuel tank interior 11 to enter the reservoir interior 114 when the level of fuel in the fuel tank 12 is higher than that in the reservoir interior.

In at least some implementations, to maximize the internal volume of the reservoir 22 while still permitting the reservoir 22 and remainder of the fuel pump assembly (other than at least a portion of the flange 18) to be received through the opening 25 in the fuel tank wall 24, the reservoir 22 may include recesses 122 (FIGS. 7, 8, 13 and 14) in which the supports 54 are partially received. Outboard of the recesses 122, an outer surface 124 of the reservoir sidewall 116 may be generally the same distance from a center or axis 126 of the fuel pump assembly 10 as is the outermost portion (e.g. outer surface farthest from the axis 126) of at least one support 54. The supports 54 may be located outboard of the reservoir interior 114 and within a diameter of the opening 25 in the fuel tank wall 24 in which the fuel pump assembly 10 is received. Stated differently, the supports 54 and exterior surface 124 of the reservoir 22 may be within a minimum diameter defined by a sealing area 128 (FIGS. 4-6) of the mounting flange 18, where the sealing area 128 is the portion of the flange 18 that is connected to the fuel tank 12.

At least part of the fuel level sender 36 may be coupled directly to the exterior 114 of the reservoir 22, and/or carrier 20 and/or mounting flange 18. The fuel level sender 36 may likewise be arranged for receipt within the fuel tank opening 25 in which the reservoir 22 is received. The fuel level sender 36 may include a float 130 coupled to an arm 132 that is also coupled to a sensor assembly 134. As the level of fuel in the fuel tank 12 changes, the float 130 moves (the float is buoyant in fuel and thus, remains on the surface of the fuel in the tank). Movement of the float 130 causes the arm 132 to move and movement of the arm 132 is sensed by the sensor assembly 134 with provides a signal indicative of the fuel level in the tank, in a known manner. The sensor assembly 134 may be coupled to the reservoir 22, and may also be located within the minimum diameter of the mounting flange 18 sealing area. In at least some implementations, the reservoir sidewall 116 includes a portion closer to the center/axis 126 and the fuel lever sender 36 is coupled to that portion of the sidewall 116. In at least some implementations, part of the arm 132 and float 130 may be located outboard of that minimum diameter in some positions of the arm 132 and within the minimum diameter in other positions of the arm 132. In the example shown, when the arm 132 is positioned so that the float 130 is farther from the mounting flange 18, the float 130 and arm 132 may be within the minimum diameter of the sealing area 128 for easy receipt of the fuel pump assembly 10 through the fuel tank opening 25.

The jet pump intake tube 104 may extend outward of the minimum sealing area of the mounting flange 18 so that a free end 136 of the tube 104 is spaced from the reservoir 22, as noted above. The tube 104 may be flexible so that it may be bent or flexed during installation of the fuel pump assembly 10 into the fuel tank 12 and received through the tank opening 25. And the tube 104 may be resilient so that the tube returns to or toward its unflexed position when received in the fuel tank to permit the free end to again be spaced from the reservoir 22 as desired.

Likewise, the vent valve 46 may be received within the minimum diameter of the sealing area, directly above (relative to the direction of gravity) the area circumscribed by the sealing area. Or the tube 110 coupled to the vent valve outlet 109 may be flexible to facilitate movement of the vent valve 46 relative to the flange 18 and receipt of the vent valve 46 into the tank opening 25 during installation of the fuel pump assembly 10.

The fuel pump 14 may be supported by the carrier 20 and/or the reservoir 22 and/or the flange 18, or any combination of these components. In the example shown, at least part of the fuel pump 14, including an inlet of the fuel pump, is received within the interior 114 of the reservoir 22 so that the fuel pump 14 can draw in fuel from the interior of the reservoir 22. The fuel pump 14 may extend through an opening 138 (FIG. 9) in the carrier 20 and may if desired be fixed to the carrier 20 by one or more connectors, snap-fit or interference fit features or in any other suitable way. A screen or filter 140 may be provided at the inlet of the fuel pump 14 to remove at least some contaminants or foreign objects from the fuel before the fuel enters the fuel pump 14. The filter 140 may be positioned at least partly against the bottom wall 118 of the reservoir 22. As noted above, the fuel pump 14 may include an outlet fitting 72 or projection that defines an outlet of the pump 14, and the fitting or projection may be received in a cavity or fitting 70 of the carrier 20. Thus, the pump 14 may be longitudinally trapped between the filter 140 (FIGS. 11 and 12) at the bottom 118 of the reservoir 22 and the carrier 20, and may be laterally retained in position by the carrier material surrounding or defining the opening 138, which may surround or define at least half of a circle or other shape complimentary to the perimeter shape of the corresponding portion of the pump (longitudinally in this instance is parallel to a centerline of the pump and laterally is perpendicular or radial to the center line). The fuel pump 14 may include a turbine type pumping element (e.g. a rotary impeller) used to pressurize the fuel, or any other suitable type, including but not limited to a positive displacement pump with rotor or other pumping elements.

In at least some implementations, the reservoir 22 may be coupled to the carrier 20 and/or one or more supports 54. In the example shown in FIGS. 5, 6, 13 and 14, the reservoir 22 at or near the upper edge or rim include connection features 142, shown as U-shaped projections that snap-fit into, on or over complementary connection features 144 in the carrier 20, shown as tabs, which may be formed on the base 60. In the other views, the connection features 142, 144 are not shown. The reservoir 22 may be fully or partially suspended above the mounting flange 18, and provide a compression force on the support(s) or the reservoir 22 may rest on and be at least partially supported by the mounting flange 18. The same carrier 20, flange 18 and components other than the supports 54 can be used with reservoirs having different heights (measured parallel to the direction of gravity). With a different height reservoir 22, supports 54 having a different length may be needed in at least some implementations to change the distance of the carrier 20 relative to the mounting flange 18. When the supports 54 are straight tubes, the length of supports can be easily changed by cutting a tube to a different length, or by otherwise provided tubes of different lengths for different fuel pump assemblies 10.

In at least some implementations, fuel not consumed by an engine may be routed back to the fuel tank 12 via a fuel return conduit (shown at 146 in phantom, in FIG. 1). The fuel return conduit 146 may be coupled to a return fuel fitting (shown at 148 in phantom in FIG. 1) of the mounting flange 18 through which the fuel may flow through the mounting flange 18 and into the fuel tank. The return fuel fitting 148 may be communicated with a support (such as the third support 54*c* which may lead to an opening 58 in the carrier) so that the returned fuel flows through the flange 18, and into a support before being returned to the interior of the fuel tank and/or the interior of the reservoir 22. The return fuel fitting 148 may be formed like the first and second fuel fittings 38, 42 in the flange, and the returned fuel may be routed through the flange (and optionally, the carrier) as described with regard to the other fittings.

The forms of the invention herein disclosed constitute presently preferred embodiments and many other forms and embodiments are possible. It is not intended herein to mention all the possible equivalent forms or ramifications of the invention. It is understood that the terms used herein are merely descriptive, rather than limiting, and that various changes may be made without departing from the spirit or scope of the invention.

The invention claimed is:

1. A fuel pump assembly, comprising:
- a mounting flange having a first surface with a sealing area, a second surface opposite to the first surface, and a fluid passage extending through the mounting flange;
- a support coupled to the mounting flange;
- a carrier coupled to the support with the weight of the carrier providing a compression force on the support;
- a reservoir carried by at least one of the carrier and the mounting flange with the weight of the reservoir acting on the carrier and/or the mounting flange, and the reservoir defining an interior; and
- a fuel pump carried by at least one of the carrier and the reservoir, the fuel pump having an inlet received within the reservoir interior and an outlet from which pressurized fuel is discharged from the fuel pump when the fuel pump is operating, wherein the support is tubular and has an internal passage that is separate from the interior of the reservoir and wherein fuel flows through the passage of the support.

2. The assembly of claim 1 wherein the reservoir is supported at least partially by the carrier, the reservoir includes a side wall extending from a lower wall, with the interior defined at least in part by the side wall and the lower wall, and wherein the lower wall is suspended above the mounting flange.

3. The assembly of claim 1 wherein the passage defined by the support is communicated with the fuel pump and wherein, when the fuel pump discharges pressurized fuel, at least some of the pressurized fuel flows through the support.

4. The assembly of claim 1 wherein the passage defined by the support is communicated with an outlet of a vent valve.

5. The assembly of claim 1 wherein the support is a first support and the fluid passage is a first fluid passage, and wherein the assembly includes a second support that is coupled to the mounting flange and to the carrier, and the mounting flange includes a second fluid passage separate from the first fluid passage, and the second support defines a passage that is communicated with the second fluid passage.

6. The assembly of claim 1 wherein the carrier includes a passage communicated with the fuel pump and with a secondary fuel pump to provide fuel from the fuel pump to the secondary fuel pump.

7. The assembly of claim 1 wherein the carrier includes a passage communicated with the fuel pump and with a pressure regulator to provide fuel from the fuel pump to the pressure regulator.

8. A fuel pump assembly, comprising:

a mounting flange having a first surface with a sealing area, a second surface opposite to the first surface, and a fluid passage extending through the mounting flange;

a support coupled to the mounting flange;

a carrier coupled to the support with the weight of the carrier providing a compression force on the support;

a reservoir carried by at least one of the carrier and the mounting flange with the weight of the reservoir acting on the carrier and/or the mounting flange, and the reservoir defining an interior; and a fuel pump carried by at least one of the carrier and the reservoir, the fuel pump having an inlet received within the reservoir interior and an outlet from which pressurized fuel is discharged from the fuel pump when the fuel pump is operating, wherein the support defines at least part of a passage through which fuel flows, wherein the mounting flange includes a first coupling feature to which the support is coupled, and the carrier includes a second coupling feature to which the support is coupled, and wherein the first coupling feature and second coupling feature both include openings communicated with the passage defined by the support.

9. The assembly of claim 1 which also comprises a fuel control valve carried by the carrier and a secondary fuel pump carried by the carrier.

10. The assembly of claim 6 wherein the secondary fuel pump includes a nozzle, a venturi and an inlet and fuel flow through the nozzle and venturi draws fuel through the inlet of the secondary fuel pump.

11. The assembly of claim 10 wherein the inlet of the secondary fuel pump is communicated with a fuel passage having an end spaced from the inlet of the secondary fuel pump so that fuel remote from the secondary fuel pump inlet may be drawn into the secondary fuel pump inlet.

12. The assembly of claim 1 wherein the reservoir has a lower wall and a sidewall extending vertically from the lower wall to retain fuel in the reservoir, and the carrier is coupled to or arranged adjacent to an upper end of the sidewall.

13. The assembly of claim 12 wherein the lower wall of the reservoir is defined by a component separate from the mounting flange and is supported on the mounting flange.

14. The assembly of claim 2 wherein the lower wall of the reservoir is defined by a component separate from the mounting flange and is spaced from the mounting flange.

15. The assembly of claim 12 wherein the lower wall is defined by the mounting flange.

16. An assembly for a fuel system, comprising:

a fuel tank having a lower wall that defines part of an interior in which fuel is received, wherein fuel is received on the lower wall under the force of gravity;

a mounting flange secured to the lower wall, the mounting flange having a first surface with a sealing area and a fluid passage extending through the mounting flange;

a support coupled to the mounting flange;

a carrier coupled to the support and suspended above the flange at least in part by the support;

a reservoir carried by at least one of the carrier and the mounting flange, and the reservoir defining an interior; and a fuel pump carried by at least one of the carrier and the reservoir, the fuel pump having an inlet received within the reservoir interior and an outlet from which pressurized fuel is discharged from the fuel pump when the fuel pump is operating, wherein the support has a first end and a second end, the support is coupled to the mounting flange at the first end and the carrier is coupled to the support at the second end, and the support defines a passage that is open to the first end and the second end, and the passage permits fluid flow through the support.

17. The assembly of claim 15 wherein the carrier includes a carrier passage communicating with a component including the fuel pump, a secondary fuel pump or a vent valve, and in operation of the assembly fluid flows through the carrier passage to an inlet of the component or fluid flows through the carrier passage from an outlet of the component.

18. The assembly of claim 17 wherein the carrier passage is communicated with the passage defined by the support.

19. The assembly of claim 18 wherein the fluid passage in the mounting flange, the carrier passage and the passage defined by the support all define part of the same fluid flow path.

20. The assembly of claim 8 wherein the first coupling feature and the second coupling feature each include either a protrusion or a cavity and wherein the support is coupled to both the first coupling feature and the second coupling feature by an interference fit or a friction fit.

* * * * *